United States Patent [19]

Collis

[11] Patent Number: 4,540,006

[45] Date of Patent: Sep. 10, 1985

[54] HAIR ROLLER

[76] Inventor: Harvey E. Collis, 12 Fitzroy Rd., London NW 1, England

[21] Appl. No.: 440,288

[22] Filed: Nov. 9, 1982

[30] Foreign Application Priority Data

Nov. 9, 1981 [GB] United Kingdom ..... 8133779
Jan. 22, 1982 [GB] United Kingdom ..... 8201853

[51] Int. Cl.[3] ..... A45D 2/02
[52] U.S. Cl. ..... 132/39
[58] Field of Search ..... 132/40, 42, 39

[56] References Cited

U.S. PATENT DOCUMENTS 2,542,601 2/1951 Van Cleef ..... 132/43 R
2,693,809 11/1954 Spencer ..... 132/43 R
2,757,676 8/1956 Hamilton ..... 132/42 R
2,838,054 6/1958 Fischer ..... 132/43 R
2,853,081 9/1958 Brancaccio ..... 132/42 R

*Primary Examiner*—Gregory E. McNeill
*Attorney, Agent, or Firm*—Ostrolenk, Faber, Gerb & Soffen

[57] ABSTRACT

A hair curling roller comprises a length of wire with an elongate cushioning foam jacket. The jacket is non-absorbent and resistant to degradation by hair lotions. End caps are provided to maintain the wire in location within the jacket and to prevent liquid access to the wire.

6 Claims, 3 Drawing Figures

HAIR ROLLER

DESCRIPTION

Figure 1:
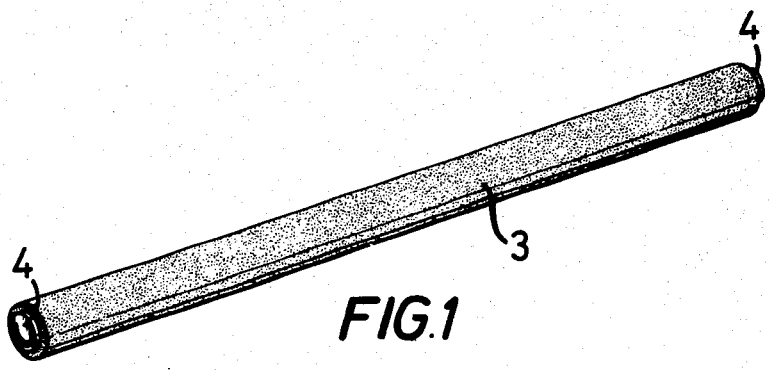

This invention relates to rollers for curling or waving hair.

A known type of hair-curling roller comprises a plastics moulding around a short, spongy roller body. The roller is used by wrapping hair around the roller body and fastening it with an elastic strap or plastic clip. Rollers of this type have several unsatisfactory features. They are heavy and uncomfortable, particularly when the user rests her head against another surface. The straps or other fixing mechanisms tend to stretch or otherwise damage the hair. Furthermore such rollers are limited to being used in a particular manner and offer very little flexibility in the choice of the eventual form of waving or curling.

The present invention seeks to provide a hair roller in which these disadvantages are alleviated.

According to the present invention there is provided a roller for curling or waving hair comprising a length of wire within an elongate, non-absorbent jacket of cushioning material, the roller being sufficiently bendable to be folded by a user, and resilient such that it retains, during curling treatment, the position into which it is folded, and wherein the roller is shaped and dimensioned such that it is adapted for use by folding to secure and maintain hair between the folded portions until the hair has been set to the desired wave or curl.

In a preferred embodiment the length of wire is terminated at each end by an end cap extending transversely to the wire and retaining the jacket in location with respect to the wire.

It will be appreciated that these end caps make it unnecessary to bond the wire to the jacket, and allow the rollers to be used in the variety of flexible positions without regard to the relative bending of the wire and jacket.

Preferably the non-absorbent jacket is fabricated from a closed-cell polymeric material.

Embodiments of the present invention will now be described, by way of example only, with reference to the accompanying drawings. In the drawings.

Figure 2:
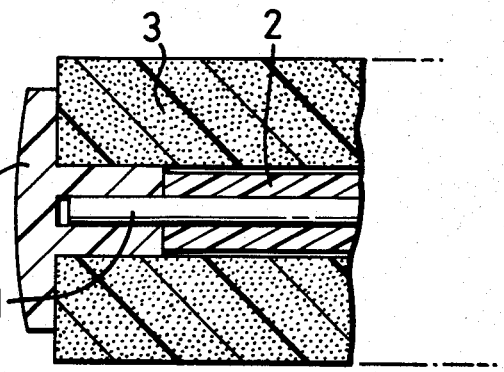
Figure 3:
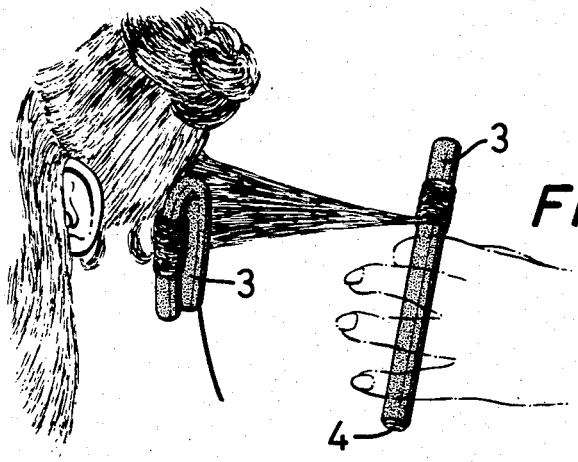

FIG. 1 is a perspective view of the roller in accordance with the present invention, FIG. 2 is an axial section through the roller of FIG. 1, and FIG. 3 is an illustration of a method of using the roller.

Referring to the Figures, a hair roller comprises a length of copper wire 1 covered by an extruded plastics sleeve 2. A cylindrical jacket 3 of cellular foamed-polyethylene surrounds the sleeved wire. The illustrated gap 5 between the jacket 3 and sleeve 2 shows that the wire 1, 2 is not bonded to the jacket 3. A mushroom-shaped end cap 4 is fixed at each end of the plastics-sleeved wire 1 by insertion of the coated wire as a tight fit into the socketed stem of the end cap. The end caps thus prevent the foamed-polyethylene jacket 3 from sliding and being displaced from the wire core. The end caps 4 also function to prevent setting or perming lotion from contacting the copper wire and so reduce the possibility of corrosion.

The roller derives from the copper wire the property of being bendable, whilst maintaining sufficient resilience to enable it to retain its bent shape once applied to the hair. Typically, the rollers are 20–25 cms long and are thus able to be bent simultaneously at several positions along their length.

FIG. 3 of the drawings shows one manner in which the rollers may be used. In general, hair is wrapped around the roller and the roller folded back on itself to retain the curled hair in this position. There is considerable freedom as to the way in which the roller is folded, and to take two examples, the roller may be folded in half as in FIG. 3 or both its ends may be folded back.

Rollers in accordance with the invention are not limited to a use in any particular hair-treating process. They may be used in association with perming lotion in a permanent wave process or with setting lotion. Alternatively the rollers may be used without additional lotions on hair which is wet or dry, with or without additional heating.

Although the rollers have been described as having a jacket of cellular foamed-polyethylene other types of material may alternatively be used. It is important however that the material should provide cushioning to the hair, and be nonabsorbent. Desirably it is water repellent and resistent to degradation by the types of lotions commonly used in hairdressing.

The rollers may be fabricated simply by introducing the plastics-sleeved wire through a length of cylindrical foamed-polyethylene, or by extruding the jacket upon the wire and cutting into desired lengths.

I claim:

1. A roller for curling or waving hair comprising a length of bendable wire within a continuous elongate jacket of cushioning material, the jacket continuously extending substantially the full length of the wire, the roller being sufficiently bendable to be folded by a user for defining a fold in the roller and folded portions of the roller on opposite sides of the fold, the roller being resilient such that the roller retains, during curling treatment using the roller, the position into which the roller is folded, and the continuous jacket being of such length that it extends over the folded portions and the fold joining the folded portions, the roller being shaped and dimensioned such that it is adapted for use by folding to secure and maintain hair between the cushioning material on the folded portions until the hair has been set to the desired wave or curl, and the wire is, along its length, unsecured within the jacket for enabling some relative movement between the wire and the jacket.

2. A roller as claimed in claim 1 in which the length of wire is covered by a plastic sleeve and the sleeve is within the jacket.

3. A roller as claimed in claims 1 or 2 wherein the length of wire is terminated at each end by a respective end cap extending transversely to the wire for retaining the jacket in location with respect to the wire.

4. A roller as claimed in either of claims 1 or 2 wherein the jacket is fabricated from cellular foamed-polyethylene.

5. A roller as claimed in claim 1, wherein the roller is bendable to be folded at various locations along its length.

6. A roller as claimed in claim 5, wherein the roller is bendable to be folded continuously along the length of the roller.

* * * * *